US008037562B2

(12) United States Patent
Kemper et al.

(10) Patent No.: US 8,037,562 B2
(45) **Date of Patent: *Oct. 18, 2011**

(54) TENSION RELIEVING BODY SUPPORT APPARATUS

(75) Inventors: Christopher E. Kemper, Aliso Viejo, CA (US); Kristi Sonsteby Kemper, Aliso Viejo, CA (US)

(73) Assignee: Kemper Support Surfaces, Inc., Carson City, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/205,432

(22) Filed: Sep. 5, 2008

(65) Prior Publication Data

US 2010/0058541 A1 Mar. 11, 2010

(51) Int. Cl.
*A47C 17/00* (2006.01)

(52) U.S. Cl. ..... 5/701; 5/740; 5/655.9; 5/727; 5/730

(58) Field of Classification Search ..... 5/740, 655.9, 5/739, 727, 730

See application file for complete search history.

(56) References Cited

U.S. PATENT DOCUMENTS

| | | | | |
|---|---|---|---|---|
| 4,316,298 | A | 2/1982 | Russo et al. | |
| RE32,734 | E | 8/1988 | McLeod | |
| 5,513,402 | A * | 5/1996 | Schwartz | 5/737 |
| 6,256,822 | B1 | 7/2001 | Weston et al. | |
| 7,469,437 | B2 * | 12/2008 | Mikkelsen et al. | 5/740 |
| 2007/0209120 | A1 * | 9/2007 | Clark | 5/729 |
| 2008/0010751 | A1 | 1/2008 | Kemper et al. | |

FOREIGN PATENT DOCUMENTS

| | | |
|---|---|---|
| JP | 2006-340824 | 12/2006 |
| JP | 2007-282774 | 11/2007 |
| KR | 20-0372620 | 1/2005 |

OTHER PUBLICATIONS

Polyurethane Foam Association; Section 4.0 Joint Industry Foam Standards and Guidelines; Published Jul. 1994; Indentation Force Deflection (IFD) Standards and Guidelines; As archived by Archive.org on Mar. 21, 2001. Full document found at http://web.arhive.org/web/20010321013931/http://www.pfa.org/jifsg/jifsgs4.html.

* cited by examiner

*Primary Examiner* — Robert G Santos
*Assistant Examiner* — Brittany Wilson
(74) *Attorney, Agent, or Firm* — Patterson Thuente Christensen Pedersen, PA

(57) ABSTRACT

A mattress including a core foam layer having a first indentation force deflection at twenty five percent compression, a first density and a first thickness. The top outer foam layer has a second indentation force deflection at twenty five percent compression, a second density and a second thickness. The first intermediate foam layer is intermediate and coextensive with the core layer and the top outer layer, and has a third indentation force deflection at twenty five percent compression, a third density and a third intermediate thickness. The first indentation force deflection is greater than the third indentation force deflection and the third indentation force deflection is greater than the second indentation force deflection.

20 Claims, 11 Drawing Sheets

Fig. 7
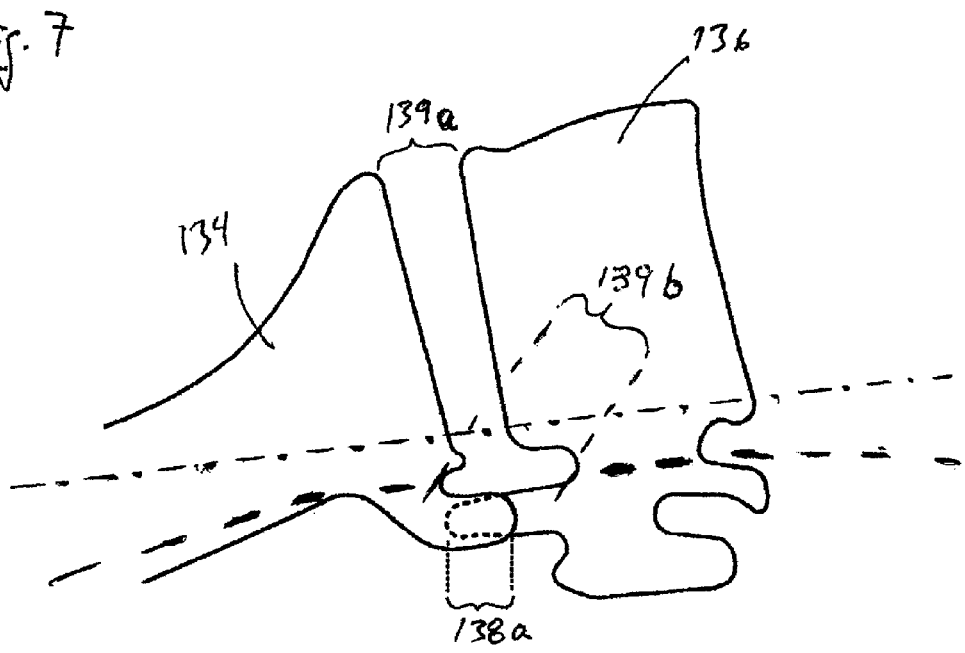
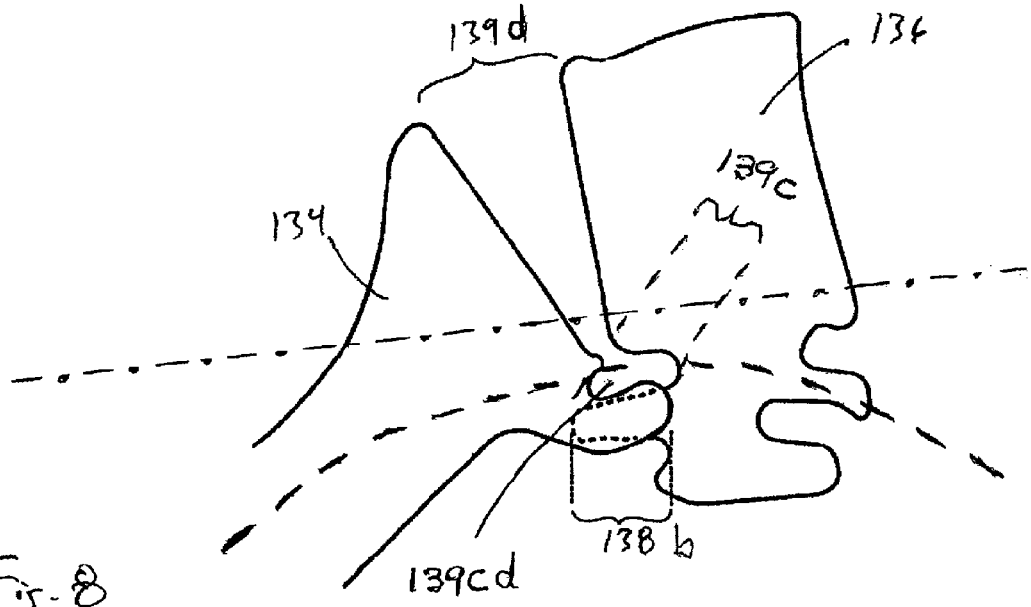
Fig. 8

TENSION RELIEVING BODY SUPPORT APPARATUS

FIELD OF THE INVENTION

The present invention relates generally to mattresses and cushions. More specifically, the present invention relates to an apparatus for supporting a human body in a prone, supine, recumbent, or sideways-lying position.

BACKGROUND OF THE INVENTION

Approximately 400 billion dollars is spent each year in treatment of back pain and sleep disorders. Of the top 100 physician prescribed and over the counter medications 75 are for spine and muscle pain or inflammation and for muscle tension or sleep disorders. According to the Centers for Disease Control, anti-inflammatories, anti-spasmodic muscle relaxants and sleep inducing sedatives are responsible for over 100,000 deaths from overdose each year. It is widely believed that these medicines and related deaths can be reduced significantly if improved posture, alignment, sleep quality and fitness were improved. Since twenty five to forty percent of our lives are spent in bed (6-9.6 hours), there is a need for a mattress or Body Support Apparatus that provides softness for desirable comfort while at the same time provides necessary firmness for proper support.

Many types of mattresses, cushions and other therapeutic pads have been developed to treat back pain and poor sleep by attempting to provide both comfort and support for the user and spine with a variety of systems. One such system uses steel springs. A shortfall created by springs is that they create zones of pressure relief with points of peak pressure where the springs meet the user's body. Elaborate attempts to cover up the springs with overlays, padding, ticking, gels, water, foam and multiple layers of additional material have been attempted. However, spring-based mattresses are generally uncomfortable, costly, noisy, heavy or fragile. Another type of mattress is the air mattress. One such embodiment has an air pump necessary to maintain pressure and or to change the firmness of the mattress by adding or removing air. One short fall of such a system is that as pressure is decreased for comfort, support is lost. Alternately, if more support is desired, comfort is lost as the mattress fills with air and becomes harder.

Other mattresses use water, gels, foam or combinations of each in attempt to achieve optimal comfort and support. Foam mattresses include those made from latex (rubber) and polyurethane (petroleum) and viscoelastic (chemically altered polyurethane) being one of the most popular at this time. Viscoelastic mattresses tend to be highly conforming. Viscoelastic foams also retain much body heat, are highly conforming, may have strong off-gassing, fluctuate in resiliency with changes in ambient temperature and are relatively heavy and expensive. Latex mattresses are highly resilient but lack support and are expensive.

Foam is generally available in a range of resiliencies, weights (Density) and Thicknesses (Layer height). The Polyurethane Foam Association's (PFA) Section 4 defines the support characteristics of foam on an Indention Force Deflection (IFD) scale. This scale grades or rates the support characteristics of foam. In particular Section 4.2.2 defines the general standard by which indentation force deflection is measured.

SUMMARY OF THE INVENTION

The present invention addresses the aforementioned needs of individuals for a mattress or cushion that is soft enough to be comfortable while having sufficient IFD to minimize mattress sag to within healthy limits to minimize or prevent sag-induced back pain, reflex spinal tension and associated disrupted sleep. For the purposes of this application, it is to be understood that a mattress will be referred to but that the principles of the invention can be applied to other devices that provide cushioned support to the human or mammalian body. These include but are not limited to seat cushions, automobile seats and other pads on which a person or animal may lie, sit or recline.

The invention prevents lumbosacral hyperextension and thoracic hyperflexion in a supine user by offering multiple layers of selected IFD foam. The IFD of the foam layers selected in accordance with the invention reduces nerve and muscle tension and pressure by preventing excessive mattress-sag-induced spinal facet imbrication and foraminal narrowing.

An example embodiment of the invention comprises a multi-layered, multi-density and multi-IFD body support apparatus that takes into consideration the physical properties of foam as defined by the PFA's IFD measurement parameters. Comfort is achieved by providing an outer layer of foam with low IFD closest to the user's skin and fat layer. This minimizes or prevents pressure points that could be uncomfortable or dangerous. The invention also takes into consideration the physical properties of foam as defined by the PFA's IFD measurement parameters to achieve support and comfort for the user's muscle tissue layer by providing foam with medium IFDs. This minimizes or prevents pressure points while providing a soft yet supportive layer similar to that of relaxed muscle tissue. In addition, the present invention takes into consideration the physical properties of foam as defined by the PFA's IFD measurement parameters to achieve support in the middle or base layer of foam to reduce or prevent excessive mattress sag that could lead to or cause lumbopelvic hyperextension and associated disc distortion, facet imbrication and foraminal narrowing. The middle or base layer of foam has an IFD selected to provide support to the user's spinal joints and can help prevent or reduce uncomfortable or dangerous sag of the internal spinal layers of the human body.

The present invention is an efficient and cost effective, non-mechanized device that meets the aforementioned needs for support and comfort by incorporating an established measurement system of Indention Force Deflection that mathematically assesses the physical performance characteristics of foam wherein the support that a selected foam will provide can be calculated into pounds per square inch. From these pounds per square inch ratings compression, deflection or support can be accurately assessed and predicted. The present invention includes layers of foam specifically chosen with IFDs, densities, layers and thickness of layers to create a mattress or Tension and Pressure Relieving Body Support Apparatus that provides comfort and support where spinal posture is maintained where spinal levels have relatively normal disc spacing, foraminal spacing and facet alignment. Although other factors such as spinal scoliosis, spinal compression fracture, severe vertebral subluxation and degenerative arthritis can have negative affects on disc spacing, foraminal spacing and facet alignment. The present invention with its selected IFD, density and layer thickness tends to reduce the negative affects of lumbosacral hyperextension. The present invention provides superior tension and pressure relief to the spine and other regions of the back.

Specifically, the Body Support Apparatus provides the spinal support that is necessary for spinal rest and optimal clearance for vascular and neural structures by reducing mattress sag-induced lumbosacral hyperextension at lumbosacral levels and thoracic hyperflexion. Improved sleep posture in turn leads to greater levels of comfort, deeper levels of sleep and spinal rest.

Pressure and tension relief is substantially uniform along the surface of the mattress or body support apparatus due to the invention's contiguous design that minimizes the existence of zones of diminished pressure or tension relief as seen in prior art mattress products that have IFDs too high or low to provide substantially uniform support to the spine. An example embodiment of the invention includes a core layer of high IFD foam, an intermediate layer of medium IFD foam, and an outer layer of low IFD foam bonded together to provide continuous and contiguous support. In different embodiments, the present invention can have between two to seven layers of foam with selected IFD, density and layer thickness. By having multiple layers of foam with the described IFDs, densities and thicknesses, the present invention may be able to facilitate the ability of the nervous system to better achieve the rest phase during sleep, promote circulation of the blood to the spine and reduce tension and pressure in the spine and muscles.

Regardless of the materials used in the construction of a mattress, sag can be avoided if layers of the mattress have appropriate indention force deflection to resist the heaviest centers of gravity of the human body at or near the sacrum and at or near the center of the thoracic spine. These areas near the sacrum exert approximately 0.5-1.5 pounds per square inch of pressure on a surface beneath the body. The areas near the center of the thoracic spine exert approximately 0.3-1.3 pounds per square inch.

BRIEF DESCRIPTION OF THE DRAWINGS

FIG. 7 is close up of a side view of a support apparatus according to an embodiment of the present invention supporting a human lumbosacral spine in the supine position with optimal or normal lumbar disc spacing, facet alignment and normal lumbar foramen.

FIG. 8 is close up side view of a human lumbosacral spine in the supine position with lumbosacral hyperextension, lumbar disc distension, facet imbrication and narrowing of the foramen.

DETAILED DESCRIPTION

Figure 1:
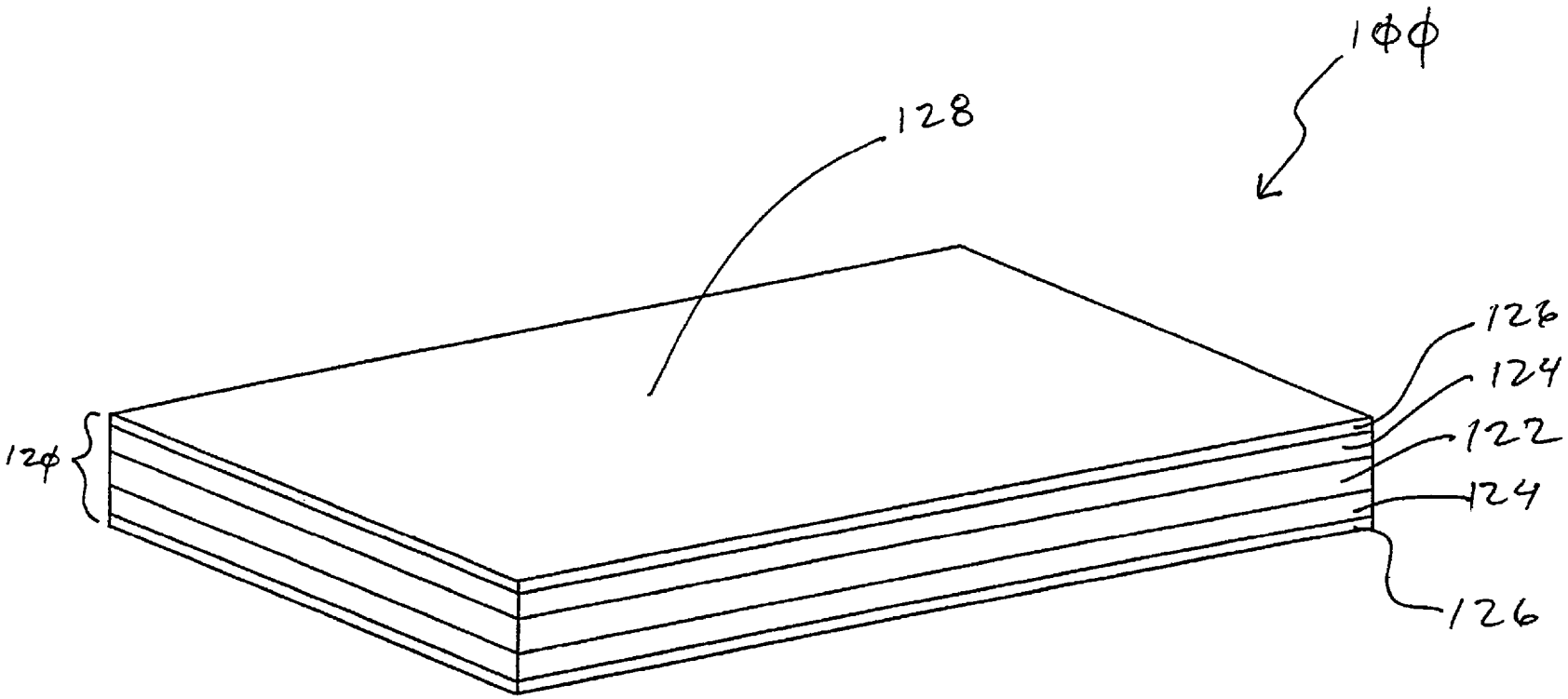
FIG. 1 is a perspective view of a support apparatus according to an embodiment of the present invention.

Referring to FIG. 1, mattress 100 generally has multiple foam layers 120. Foam layers 120 may include core layer 122, intermediate layers 124, and outer layers 126. Mattress 100 presents top surface 128. Top surface 128 of mattress 100 generally evenly redistributes the weight of a user through foam layers 120 to minimize pressure points and mattress sag between the user and mattress 100.

Although mattress 100 illustrated in FIG. 1 has five foam layers 120, mattress 100 can have two to seven foam layers 120 without departing from the spirit and scope of the present invention.

With regard to foam layers 120 making up mattress 100, core layer 122 generally has a relatively high IFD, intermediate layers 124 generally have a relatively medium IFD, and outer layers 126 generally have a relatively low IFD. Each intermediate layer 124 is generally coextensively positioned between core layer 122 and outer layer 126. In an example embodiment, the IFD of each foam layer 120 provides support to a corresponding body tissue such as: skin and fat are supported by outer layers 126; muscle IFD is supported by the intermediate layer(s) 124; and spinal joints are supported by the core layer 122.

In different applications, mattress 100 can simultaneously provide comfort and spinal support to a user assuming a supine position, a recumbent position, or a sideways-lying position.

Mattress 100 can also promote relaxation of spinal pressure and muscle tension that increasingly accumulates over time due to gravity where muscle fatigue and spinal compression progressively compromises the function of the neuromusculoskeletal (nerve, muscles and spine) structures. Specifically, mattress 100 is made from foam layers 120 that vary in IFD or memory such that outer layer 126 is comprised of the lowest IFD material similar to that of skin and fat. The intermediate foam layer or layers 124, as shown in FIG. 1 provide support with an IFD that is similar to muscle tissue. Core layer 126 is made with an IFD that is much firmer yet still resilient to provide spinal support at or near the spinal centers of gravity where the heavier levels of the spine rest. Foam layers 120 can have the same thickness or different thicknesses generally ranging from one half inch to five inches. Core layer 122 is generally the thickest foam layer 120, while outer layers 126 are generally the thinnest foam layers 120. While generally true this should not be considered to be limiting. Mattress 100 distributes the weight of a user over top surface 128 while still providing support to the entire body including spinal regions 132, 134 and 136 of the user.

Specifically, mattress 100 helps maintains proper curvature of spine 132 and orientation of sacrum 134 and lumbar 136 of a user, such as, for example, a user in the supine position, as depicted in FIGS. 2, 3, 5 and 7. Mattress 100 contiguously and uniformly supports spinal regions 132, 134 and 136 of a user with multiple cushioning components of foam layers 120. These layers are positioned specifically to match the order of tissue from external to internal such as skin/fat, muscle and spine. Therefore, the order of placement of each layer 126, 124 and 122 are part of the invention. Reversible embodiments of the invention reverse the relative orientation of layers located on the side of the body support apparatus not in use. That is the bottom side of mattress 100.

The specific IFDs of layers 120, densities of layers 120, thicknesses of layers 126, 124, and 122 and number of layers are the subject of this invention. Therefore, the comfort and support quality of mattress 100 is created by at least 4 distinct Physical Features and Support Characteristics including:

IFD
density
layer thickness and
the number of layers of mattress 100.

Mattress 100 minimizes pressure points on the skin/fat layer with its low IFD top layer(s) 126. Mattress 100 cushions muscle tissue with its medium IFD layer(s) 124. Mattress stabilizes the spine, reducing sag with its firm IFD layer 122. Each of layers 122, 124 and 126 contribute to both comfort and support by their physical performance defined by their respective IFDs wherein each layer of foam deflects under a load of a specific number of pounds per square inch and compresses to specific percentage of a foam layer's original thickness.

Figure 4:
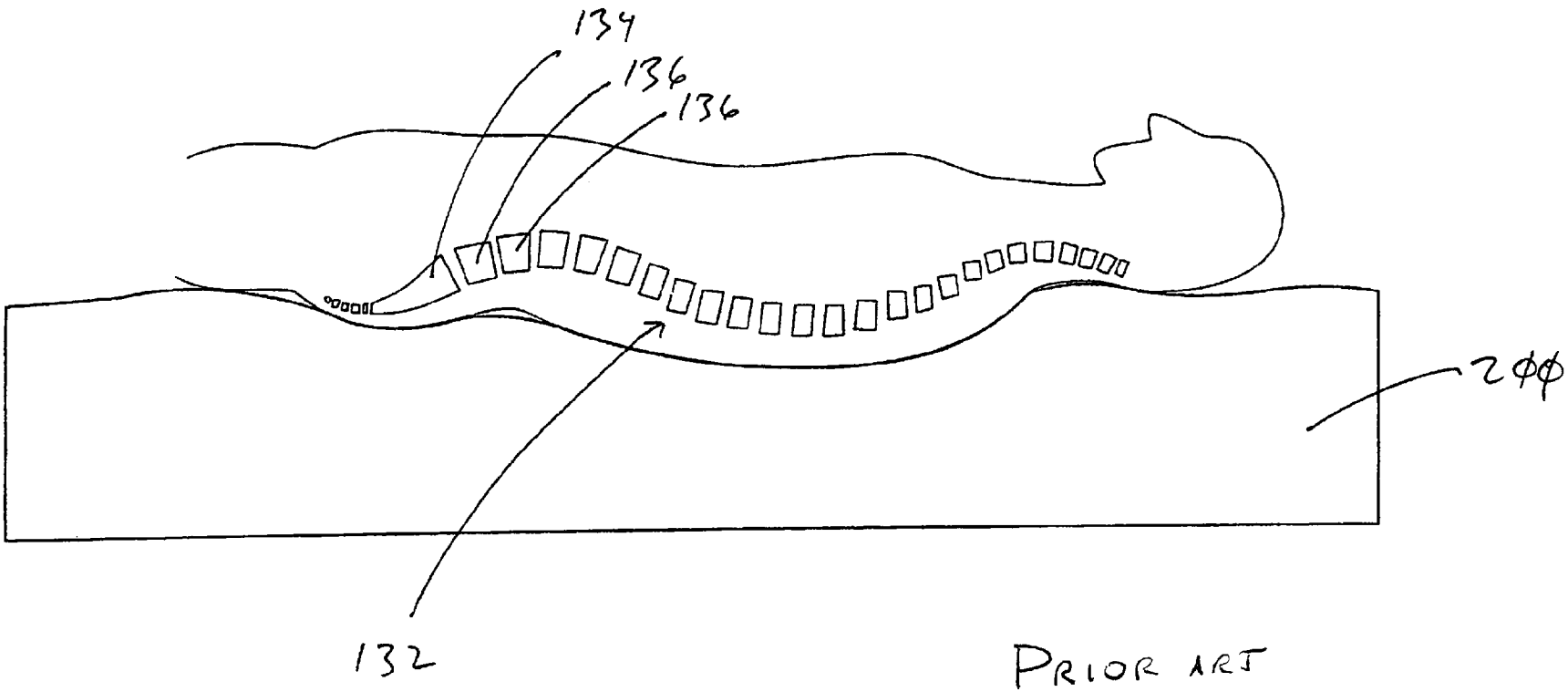
PRIOR ART FIG. 4
FIG. 4 is a side view of a human spine in the supine position with excessive mattress sag and associated thoracic hyperflexion.
Figure 6:
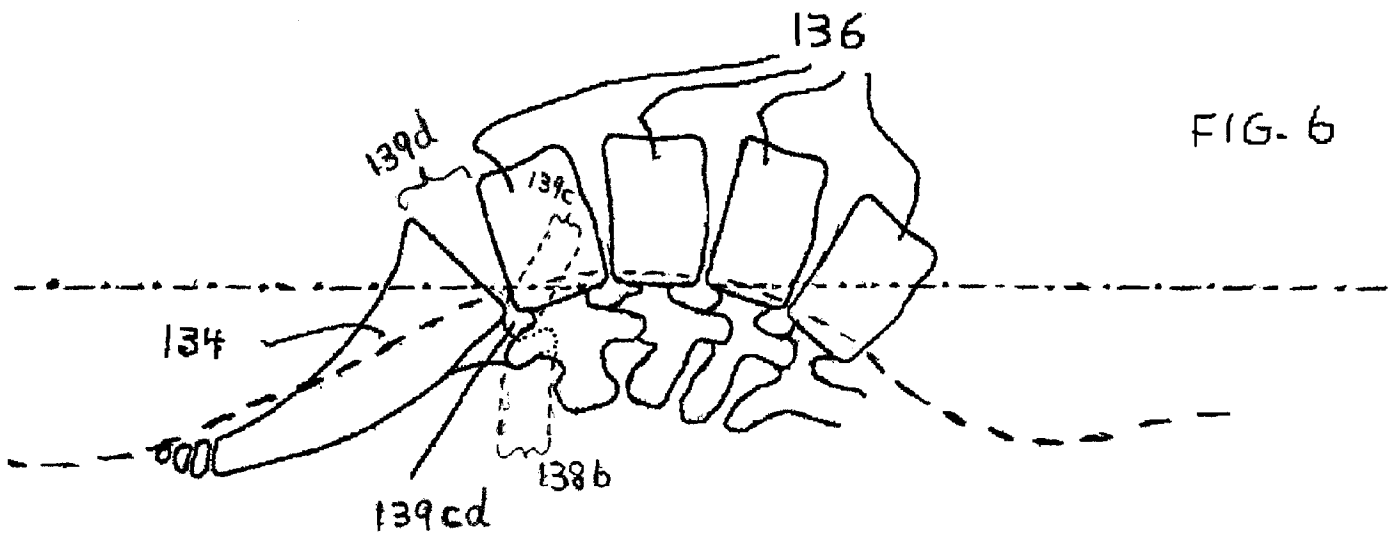
FIG. 6 is a side view of a human lumbopelvic spine in the supine position without adequate support wherein mattress sag is causing lumbopelvic hyperextension, lumbar disc distension, lumbar facet imbrication and narrowing of the lumbar foramen.

By contrast, prior art mattresses 200 tend to conform to the spine or support the spine insufficiently and can promote exaggerated hyperflexion of the thoracic spine along points 132 as depicted in FIG. 4. Similarly, insufficient support or too much mattress conformation can lead to lumbosacral hyperextension 139*c*, 139*d* and 139*cd* at levels 134 and 136 as depicted in FIGS. 6 and 8.

Figure 2:
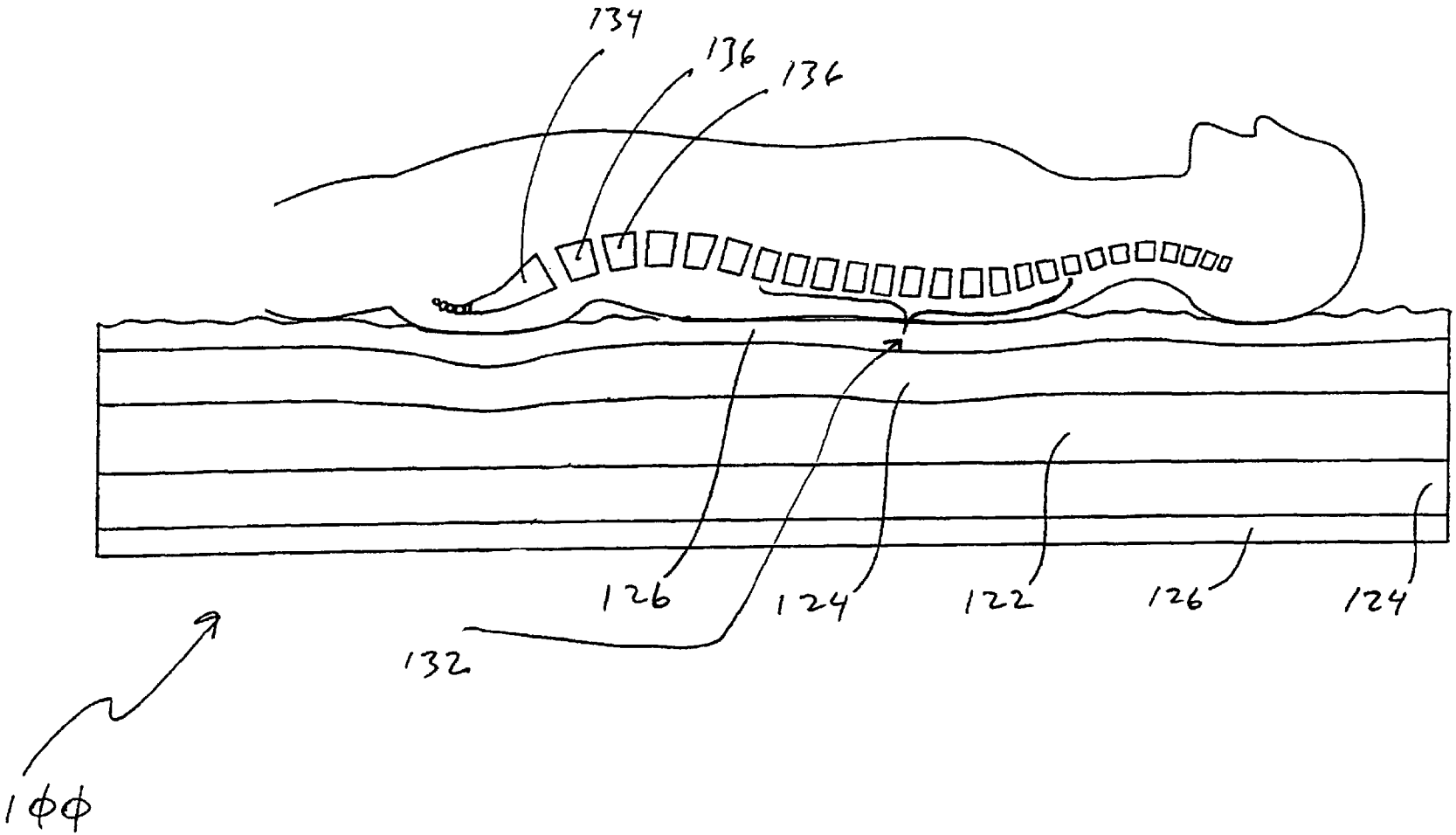
FIG. 2 is a side view of a support apparatus according to an embodiment of the present invention supporting a human body.
Figure 3:
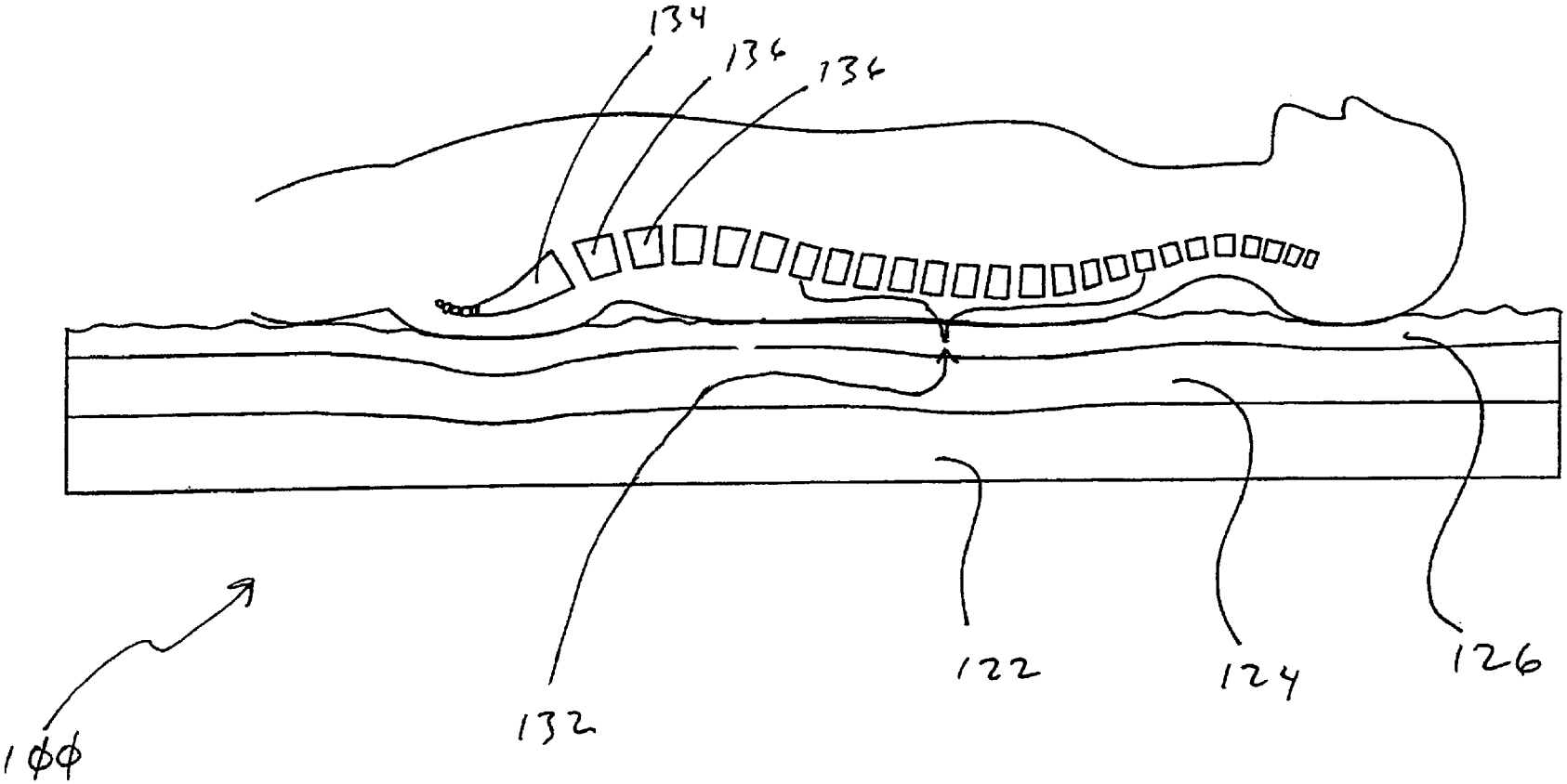
FIG. 3 is a side view of a support apparatus according to an embodiment of the present invention supporting a human body.

FIGS. 2-3, show normal spinal posture provided by mattress 100.

In an example embodiment, mattress 100 has five foam layers 120, including single core layer 122, two intermediate layers 124, and two outer layers 126, as depicted in FIG. 2. By having multiple intermediate and outer layers 124, 126, mattress 100 in this embodiment is reversible.

In another embodiment, mattress 100 has three foam layers, including single core layer 122, single intermediate layer 124, and single outer layer 126, as depicted in FIG. 3. Other embodiments of the present invention can have two to seven layers 120 without departing from the spirit of scope of the present invention.

Foam layers 120 may be attached to each other, for example, by a variety of flexible adhesive bonding agents placed between layers 120. In an example embodiment, foam layers 120 are attached to other foam layers 120 with a chemical adhesive spread along the perimeter of foam layers 120. In another embodiment, foam layers 120 are bonded together with individual areas of adhesive sufficient to cause the layers 120 to perform as one integral unit. Other bonding techniques may be used as well, including but not limited to double sided adhesive tape, hot melt adhesives and heat bonding.

Referring to FIG. 2, outer layer 126 presents top surface 128 of Mattress 100 on which a user can position him or herself in a supine, recumbent, or sideways-lying position.

Outer layers 126 present a tactile-comfort layer similar in softness to human skin/fat. In some embodiments of the invention, outer layers 126 are self ventilating. In an example embodiment, the composition of outer layer 126 is a non-viscoelastic foam, not reactive to body heat, and able to provide continuous support. Specifically, outer layers 126 of mattress 100 provide tactile comfort and dermal support to a user by having qualities substantially similar to human skin and subcutaneous tissue. In an example embodiment, outer layers 126 are made from foam with an IFD of ten to twenty, density from about two and three quarters to four and one half pounds per cubic foot and thickness between 1-3 inches. The IFD, density and thickness of outer layer 126 can be varied so as to provide more or less support to the skin and subcutaneous tissue. For example, outer layer 126 can be comprised of latex foam or of polyurethane foam.

Referring to FIG. 2, intermediate layers 124 are situated between core layer 122 and outer layers 126. Generally, intermediate layers 124 provide a muscle-support and muscle-comfort or muscle relaxation layer by having a medium IFD rebound or memory while maintaining continuous support firmer than outer layer 126. Specifically, intermediate layers 124 can provide such musculature comfort and support by having an IFD and density that is substantially similar to the IFD of relaxed muscles. In an example embodiment, intermediate layers 124 are made of polyurethane. Intermediate layers 124 can be formed of foam with an IFD between 25 and 35, a density between about one and one half pounds and about two and one half pounds per cubic foot and a thickness of between about one inch and about five inches.

In an example embodiment, intermediate layers 124 have a thickness of approximately two and one half inches and have a density of approximately 1.85 pounds per cubic foot.

Intermediate layers 124 can thereby support the denser and heavier muscle tissue located below the skin.

Referring to FIGS. 2-3, core layer 122 is situated between intermediate layers 124 or beneath one intermediate layer 124. Core layer 122 enables mattress 100 to adequately support spine levels 132, 134 and 136 of a user, as depicted in FIGS. 2, 3, 5 and 7. To support the spine 132, core layer 122 helps limit hyperflexion of the thoracic spine, reduce rounding of the shoulders and may help prevent Dowager's deformity.

In one embodiment of the invention, core layer 122 is comprised of a foam layer with an IFD of 80, a density of 2.8 pounds per cubic foot and a thickness of about four inches to prevent lumbopelvic hyperextensions and mattress sag in users weighing up to 700 pounds.

Figure 5:
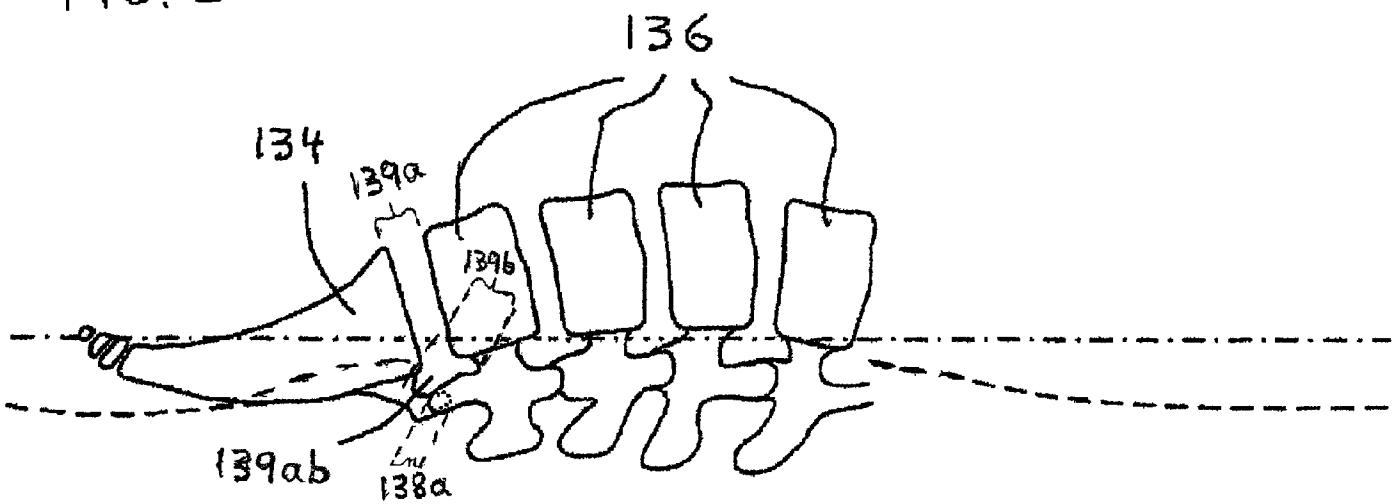
FIG. 5 is a side view of a support apparatus according to an embodiment of the present invention supporting a human lumbopelvic spine in the supine position achieving optimal lumbar disc spacing, lumbar facet alignment and lumbar foramen spacing.

By preventing mattress sag, core layer 122 helps prevent the pelvis and sacrum 134 from sagging into hyperextension, as depicted in FIGS. 5 and 7. Referring to FIG. 7, sacrum 134 and lumbar vertebra 136 achieve normal anatomic joint overlap region 138*a*, normal disc space 139*a* and normal foraminal gap 139 *b*.

In contrast, as depicted in FIGS. 6 and 8, a prior art mattress 200 tends to allow sagging of the pelvis and sacrum 134 into hyperextension. Hyperextension of sacrum 134 in relation to vertebra 136 tends to cause facet imbrication 138*b*, disc distension 139*d*, and a narrowing of foramen 139*c* and 139*cd*.

Mattress 100 therefore, by reducing mattress sag and associated sacral hyperextension and thoracic hyperflexion helps promote anatomically desirable spinal posture important for recovery from gravity-induced spinal compression and tension and muscle fatigue that accumulates during the user's day.

Mattress 100 generally resists mattress sag and therefore reduces tension and pressure on and/or around the spine, including its intrinsic anatomical elements.

Physical features and support characteristics of an example embodiment of mattress 100:

1. Indention force deflection, ranging from about 10 IFD to about 90 IFD.

The majority of the surface area of a user's body exerts between 0.3 pounds per square inch and 1.6 pounds per square inch when lying down on a support surface of typical mattress 200 or mattress 100. The Polyurethane Foam Association's (PFA) definition of Indention Force Deflection (IFD) rates the resistance or ability of a particular foam in terms of the pounds of force required to compress a given foam from its original uncompressed height to a given percentage of its original uncompressed height by applying a force with a 50 square inch circular compression/indention device. In one example of IFD, a four inch thick layer of foam is compressed twenty five percent so that the foam becomes three inches thick. If the amount of force required to compress a layer of four inch thick foam to three inches is eighty pounds, the foam is said to have an IFD of eighty pounds. In another example of IFD, if the force required to compress a two inch thick layer of foam to one and a half inches is fifteen pounds, the foam is said to have an IFD of fifteen pounds.

2. Density in pounds, for foam comprising mattress 100, ranges from about 1.5 pounds to about 4.5 pounds. Density is the weight of a given foam per cubic foot. Foam that weights four pounds per cubic foot is said to have a density of four pounds. In another example of foam density, if a cubic foot of given foam weighs 1.8 pounds the foam is said to have a density of 1.8 pounds.
3. Specific thicknesses of each layer, ranging from about one half inch to about 5 inches is the distance from the top of the given layer to the bottom of the same given layer in an uncompressed state. The thickness of layers 120 range from about one half inch to about five inches, according to the specific embodiment of mattress 100. Generally, the thickness is consistent at all points of any given layer except for in medical products where the base layer may be curved to reduce sag in a "sling-type" wheelchair seat and to reduce sag along the longitudinal axis of hospital bed frames.
4. Specific number of layers, ranging from two to seven.

In one embodiment of invention mattress 100 has five layers and is reversible. In this configuration the top and bottom layers are similar in physical features and support characteristics. The intermediate layers above and below the core are also the same or similar in physical features and support characteristics and is reversible.

In another embodiment of the invention, mattress 100 has seven layers and also can be reversible. In this embodiment of the invention, opposing layers on either side of the core would have the same or similar physical features and support characteristics to remain reversible. In still another embodiment of the invention mattress 100 could have two, three or four layers, each with different physical features and support characteristics generally progressing with lower IFDs on the top to the highest IFDs on the bottom according to the typical change in tissue density of the user where the most outer or external tissues, such as skin and fat, have the lowest IFDs, the more intermediate tissues such as muscle tissue have a higher IFD than skin and fat and the most internal tissues such as the spine have the highest IFDs, higher than muscle and skin and fat.

Pressure mapping reveals that the weight or force exerted per square inch upon a support surface by the human body while lying supine, prone, lateral, sideways-lying or recumbent varies from zero pounds per square inch at points where the body does not come in contact with the support surface such as the area behind the knees or neck, to about 1.6-2.0 two pounds per square inch beneath the centers of gravity of the heaviest regions of the spine or bony protuberances. For example, in one embodiment of the invention, a two hundred and fifty pound muscular male may exert, on average, 1.5 pounds per square inch while lying down. This individual may find optimal comfort and support in accordance with the invention as follows:

A four inch core layer 122 with an IFD of 80 which is rated to be capable of resisting compression beyond twenty five percent or three inches or to resist and support approximately 1.6 pounds per square inch.

Two and one half inch intermediate layers 124 (total of 5 inches one above and one below core layer 122) with IFDs of 28 which are rated to be capable of resisting compression beyond twenty five percent or to approximately 3.75 inches, or to resist and support approximately 0.56 pounds per square inch.

A two inch top layer 126 with an IFD of 15 which is rated to be capable of resisting compression beyond twenty five percent or to 1.5 inches or to resist and support approximately 0.3 pounds per square inch.

In this embodiment of the invention, the combined layers 120 can support 2.46 pounds per square inch. In this embodiment of the invention, a 250 pound muscular male would be easily supported, without significant sag, by mattress 100's tissue density-specific layering, given the choice and ranges of combined IFD, density, layer thicknesses and number of layers.

In another example, in the case of a person who weighs less or who wants a softer mattress but not at the expense of sag, layers 124 and 126 can be made thicker and layer 122 can be made thinner. Increased comfort without sacrifice of support is available within the various embodiments of this invention.

The weight of adult human beings generally varies from 120 to 250 pounds with some exceptions. While the 130 pound difference in average human adult weight seems great, the pressure, in pounds per square inch they exert while lying prone, supine, recumbent or side ways lying is very similar. For example, a 120 pound adult female averages about 0.45 pounds per square inch while supine or prone and about 0.60 pounds per square inch while lying on her side. In another example, a 190 pound adult male averages 0.5 pounds per square inch while supine or prone and about 0.65 pounds per square inch while lying on his side. And a 280 pound male also averages 0.5 per square inch while supine or prone and about 0.65 pounds per square inch while lying on his side. With foam IFDs ranging from 10 to 90 and the weight per square inch, they can resist at 25% deflection ranging from approximately 0.3-1.8 pounds per square inch. Mattress 100, in accordance with the invention, can be designed to create support to effectively prevent sacral hyperextension and thoracic hyperflexion while providing soft top layer(s) for the skin and fat of the user, intermediate layers for relaxation of the user's muscles and optimal support for the user's spine.

Figure 9:
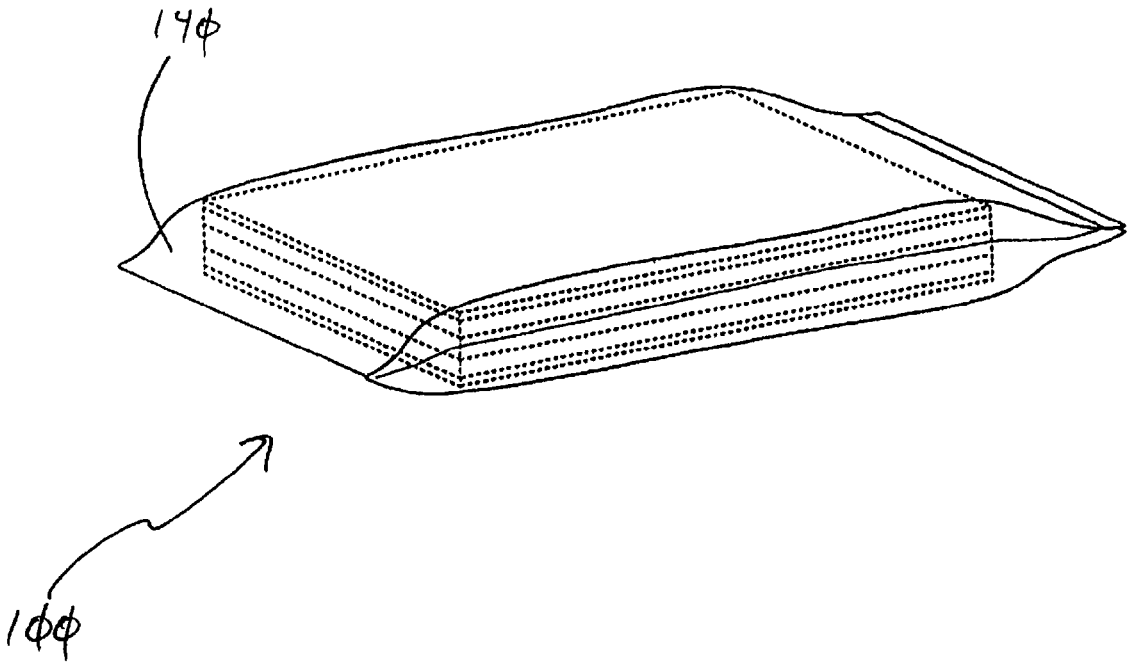
FIG. 9 is a perspective view of a fluid proof cover for the support apparatus according to an embodiment of the invention.

Referring to FIG. 9, mattress 100 can include removable cover 140. Removable cover 140 can be made from any number of materials that do not materially affect the overall comfort and support characteristics of mattress 100.

In an example embodiment, removable cover 140 is waterproof and washable to within medical disinfectant standards and substantially encloses foam layers 120. Specifically, removable cover 140 can be made from a material that also has anti-microbial properties.

Figure 10:
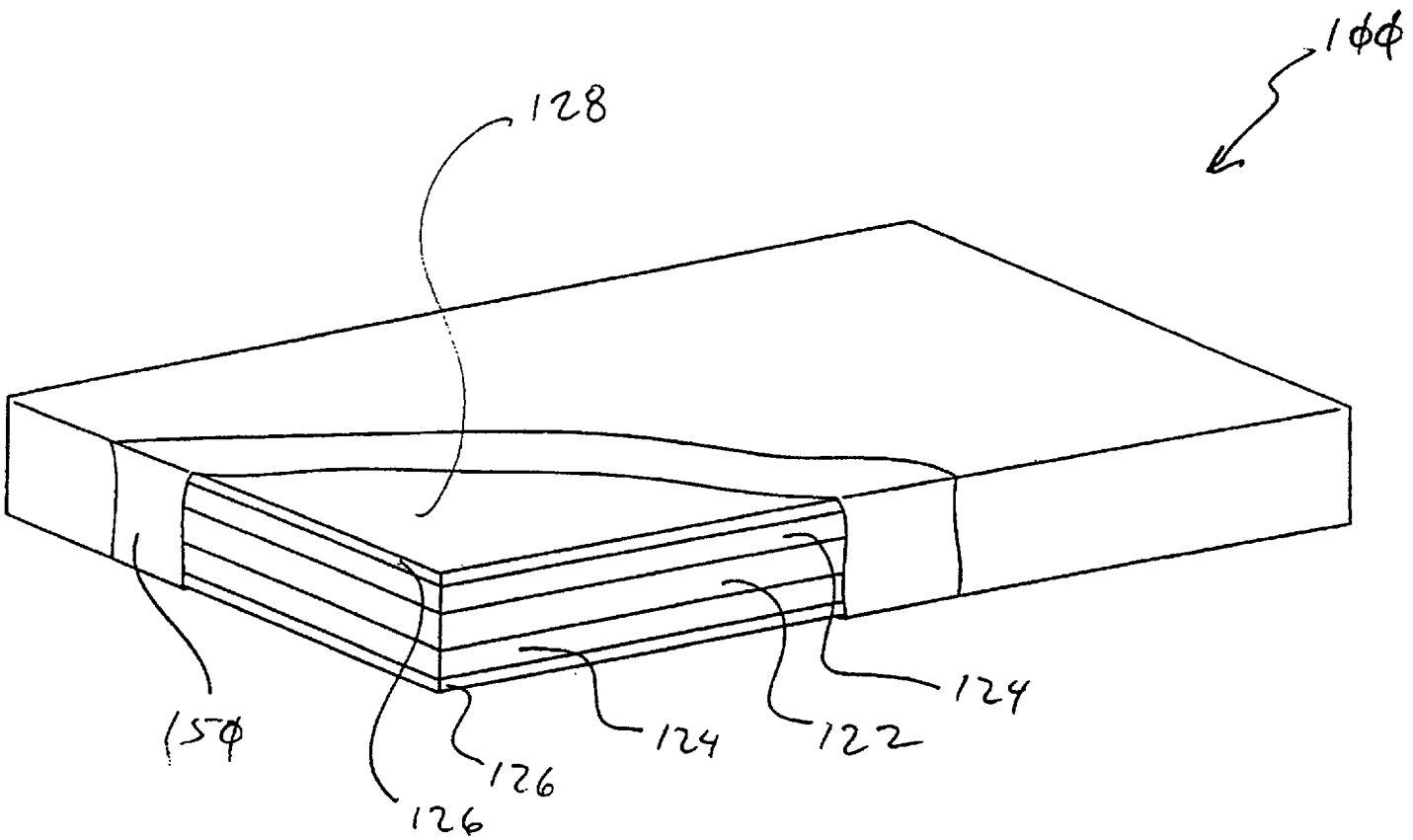
FIG. 10 is a perspective view of a support apparatus according to an embodiment of the invention.

Referring to FIG. 10, Mattress 100 can include a safety cover(s) 150. Specifically, safety cover 150 can be made from a material or contain an additive, treatment or other physical properties having fire-retardant or fire-resistant qualities. In an example embodiment, safety cover 150 meets or exceeds relevant life safety code requirements for health care institutions, such as, for example, applicable state and federal governmental laws, rules, and administrative regulations.

Removable cover 140 and safety cover 150 can be secured around foam layers 120 in any number of ways. In an example embodiment, removable cover 140 or safety cover 150 is secured around foam layers 120 by a zipper mechanism. In other embodiments, removable cover 140 or safety cover 150 is secured around foam layers by buttons, snaps, hook-and-loop fasteners, or other suitable fastening members.

Figure 11:
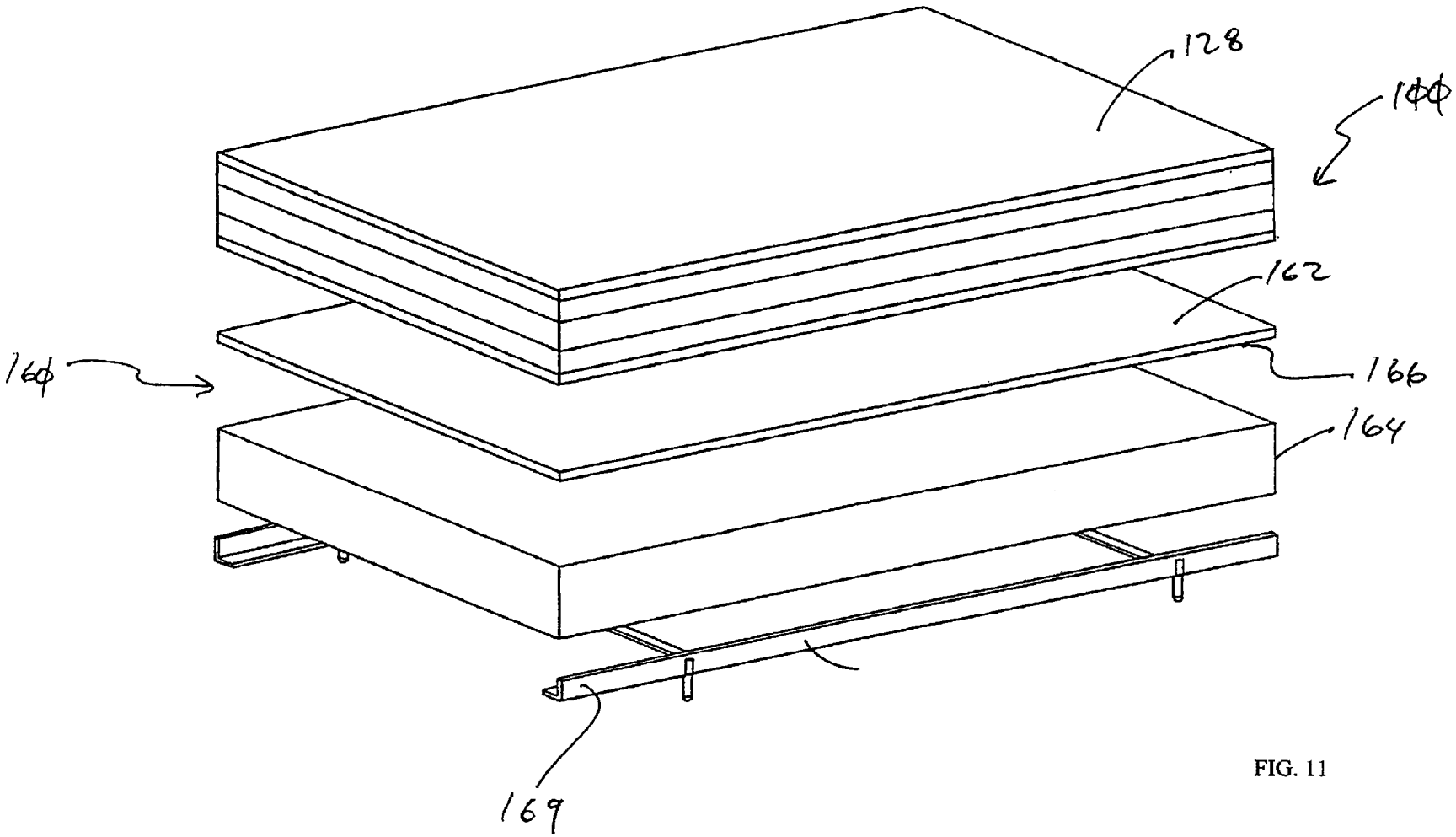
FIG. 11 is a perspective view of a support apparatus according to an embodiment of the invention.

In another embodiment of the present invention, support pad 100 rests upon foundation 160, as depicted in FIG. 11. Foundation 160 generally includes top surface 162 and bottom surface (not shown). Foundation 160 may be made from any substantially rigid structure. When support pad 100 is rested upon foundation 160, bottom surface (not shown) of support pad 100 is substantially coextensive with top surface 162 of foundation 160. In an example embodiment, foundation 160 is formed from a box without springs 164.

Foundation 160 may conformingly fit on frame 169, as depicted in FIG. 11. Referring to FIG. 11, foundation cover 166 can be placed on top of box spring 164, while support pad 100 can be placed on top of foundation cover 166. Foundation cover 166 may be made of any substantially rigid material that conforms in shape to the bottom surface of support pad 100 and may be selected to have any number of thicknesses. In an example embodiment, foundation cover 166 is made from plywood having a thickness of approximately five-eighths of one inch. Although box spring 164 and foundation cover 166 may have any number of sizes and shapes, box spring 164 and foundation cover 166 generally are the same size and shape as mattress 100.

Figure 12:
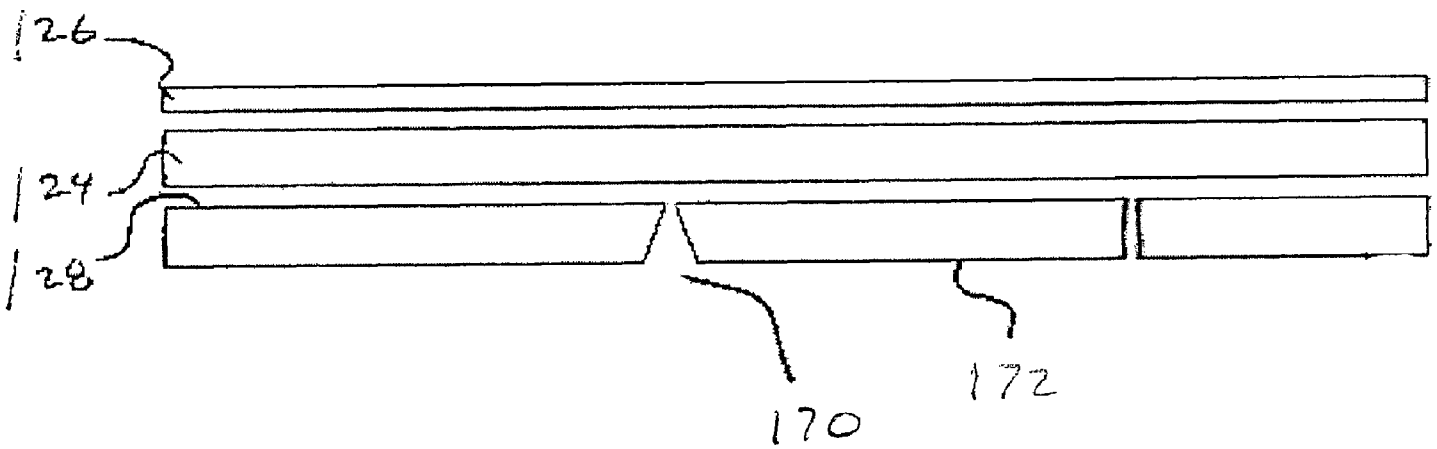
FIG. 12 is an elevational exploded view of a support apparatus in accordance with the invention.
Figure 13:
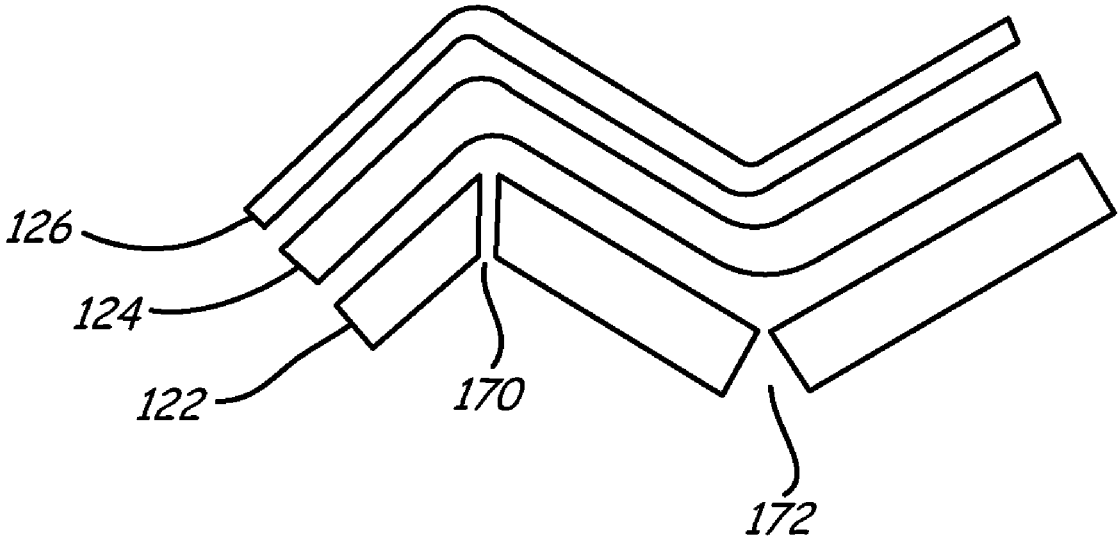
FIG. 13 is an elevational exploded view of the support apparatus of FIG. 12 in a bent configuration.

Referring to FIGS. 12 and 13, another example embodiment is depicted in which core layer 122 is interrupted by joints 170 and 172. The interruption of core layer 122 by joints 170 and 172 allow flexure of mattress 100 for use with an adjustable bed that is favored by some for sleeping or for use by those who desire a sleeping position with the head raised, the knees bent or both. Note that foam layers 120 are depicted in FIGS. 12 and 13 as separated for clarity. In accordance with the invention, layers 120 are bonded together.

In operation, to prevent the human spine from sagging into an uncomfortable or unhealthy posture, a mattress in accordance with the present invention is constructed with materials that can withstand the heaviest portions of a human body as depicted in FIGS. 2, 3 and 4. FIGS. 2, 3, 5 and 7 depict a desired anatomical posture made possible by mattress 100. FIGS. 4, 6 and 8 illustrate the affect that excessive mattress 200 sag or conformation can have upon the human spine. Mattresses that are too hard can create pressure points on the shoulders, hips, sacrum, coccyx and heels. Excessive IFD at the mattress surface, for example, can irritate the skin and prominent bony sites of the user. Even when the user is a healthy individual, the resulting pressure points can impede circulation and, in turn, cause increased heart rate, blood pressure and general discomfort resulting in disrupted sleep. When considering the medically fragile, prior art mattresses can aggravate spinal arthritis or in the case of mattresses with excessive IFDs can lead to pressure ulcers. Similar problems are also often associated with seat cushions that have IFDs which are too high or too low.

Mattresses that are too soft, or conform too much, lack adequate support and can allow the spine to sag into either sacral hyperextension as shown in FIGS. 6 and 8 or sag into thoracic hyperflexion or kyphosis as shown in FIG. 4. Mattresses without adequate IFD to support the spine in an anatomically neutral or proper posture can lead to or cause lumbosacral hyperextension as depicted in FIG. 8 and facet imbrication 138*b* and associated foraminal narrowing 139*c* shown in FIGS. 6 and 8.

Lumbosacral Hyperextension as shown in FIG. 8 and associated facet imbrication 138*b* is the leading cause of resting-induced chronic back pain and restless leg or disrupted sleep syndromes. Sacral hyperextension mechanically decreases the size of the neural foramen 139*c* which are the passageways for nerves and blood vessels coursing to and from the spinal cord. Sleeping year after year on a sagging mattress, without adequate IFD to prevent lumbosacral hyperextension and facet imbrication, can lead to progressive occlusion of the foramen 139*c* and a chronic tensioning or compression of the dural sleeve, nerve root or associated blood vessels. This crowding, pinching or narrowing of the spinal foramen 139*c* at the level of lumbosacral hyperextension, as depicted in FIGS. 6 and 8 can impair venous drainage, arterial flow and nerve conduction causing discomfort, restlessness, pain, numbness, neuritis and other neuromusculoskeletal symptoms. Lateral distortion of the spine caused by sleeping without proper support while on one's side, can also lead to imbrication of the spinal joints and reflex tensioning of the spinal muscles and associated interruptions in sleep patterns.

While supine or lying sideways, the thoracic region is the second heaviest level of the spine requiring support. Other sag-induced, posture-related spinal conditions can occur in the thoracic spine 132. As depicted in FIG. 4, mattresses lacking sufficient support for the thoracic spine 132 can lead to hyperflexion of the upper thoracic region, kyphosis and Dowager deformation. The present invention supports the user's spine particularly at the centers of gravity or the heaviest regions of the human body 134 and 132, while at the same time offering softness sufficient to prevent pressure points on the skin and boney protuberances. The invention achieves both adequate support and comfort by presenting a lower IFD at the surface that contacts the user. The present invention is not dependent on motorized air pumps, steel springs, fluids, gels or combinations of any or all of the materials listed to achieve optimal support and comfort. The invention utilizes multiple layers of foam of varying IFDs sufficient to minimize mattress sag to within healthy limits. The invention is durable and does not present the drawbacks of the foam products known viscoelastic ("memory") or low IFD foam.

The mattress in accordance with the invention, the order of layers is based on IFDs generally ranging from the lowest nearest the user, progressing to the highest IFD at the core, in the example of the reversible embodiment of the invention. In the example of a non-reversible embodiment of the multi-layer therapeutic body support apparatus, the highest IFD layer is the furthest away from the user, the intermediate IFD layer is closer to the user than the highest IFD layer and the lowest IFD layer is the closest to the user.

Indention force deflection (IFD) as defined by the Polyurethane Foam Association (PFA) uses a 50 square inch circular presser foot to compress foam to a stated percentage. Generally, the percentage of compression is stated as either twenty five percent or sixty five percent. The IFD values referenced in this application are at twenty five percent deflection. This standard is widely accepted to be reliable and accurate.

Utilizing Indention force deflection (IFD) scale as defined by the Polyurethane Foam Association (PFA) the support created by a given IFD over a 50 square inch surface area can be converted into pounds per square inch by dividing by 50.

Pounds per square inch supported by foam within the ranges 10-90 IFD, as described in various embodiments herein, per the PFA's definition of IFD, are as follows:

0.2 pounds per square inch for foam with an IFD of 10
0.4 pounds per square inch for foam with an IFD of 20
0.5 pounds per square inch for foam with an IFD of 25
0.7 pounds per square inch for foam with an IFD of 35
1.5 pounds per square inch for foam with an IFD of 75
1.8 pounds per square inch for foam with an IFD of 90

Pressure per square inch exerted by the human body on a supporting surface can be measured with any number of pressure mapping devices that utilize pressure sensitive digital cells metered by computer software and hardware. This standard is widely accepted to be reliable and accurate.

For example, the Tek Scan BPMS 5.90 pressure mapping system was used to measure average and peak pressure of human subjects all of whom exerted from between zero pounds per square inch at point of the body not in contact with the pressure sensitive digital cells to 2.0 pounds per square inch beneath the centers of gravity of the human body and/or at points where boney protuberances created the highest pressures. Average pressure ranged from about 0.45 pounds per square inch in small adult females while prone or supine (about 0.6 pound while lying on the side) to about 0.5 pounds in large adult males. Average pressures ranged up to about 1.5 pounds per square inch in users of extreme size, weight or magnitude of boney protuberances (about 2.0 pounds while lying on the side.)

Compression modulus, also known as support factor, is a measure of a foam's ultimate ability to support a load placed upon it. Compression modulus may include a "Softness" compression modulus which is indicative of the surface feel of a foam cushion or layer and a "Support" compression modulus which is indicative of the foam's ultimate ability to support a load placed upon it. "Softness" compression modulus is calculated by dividing the IFD at 25% deflection by the IFD at 5% deflection. "Support" Compression modulus is calculated by dividing the IFD at 65%, and deflection by the IFD at 25% deflection. In an example embodiment of the invention, outer layer 126 has a softness compression modulus of about 1.75 to about 2.35. In another example embodiment, intermediate layer 124 has a support compression modulus of about 1.7 to about 2.6. In another example embodiment, core layer 122 has a support compression modulus of about 1.9 to about 2.3.

The invention may be embodied in other specific forms without departing from the spirit of the essential attributes thereof; therefore, the illustrated embodiments should be considered in all respects as illustrative and not restrictive, reference being made to the appended claims rather than to the forgoing description to indicate the scope of the invention.

What is claimed:

1. A mattress comprising:

a core foam layer having a first indentation force deflection at twenty five percent compression, a first density and a first thickness;

a top outer foam layer having a second indentation force deflection at twenty five percent compression, second density and a second thickness;

a first intermediate foam layer intermediate and coextensive with the core layer and the top outer layer and bonded to the core layer and the top outer layer; and having a third indentation force deflection at twenty five percent compression, a third density and a third intermediate thickness;

wherein the first indentation force deflection is greater than the third indentation force deflection and the third indentation force deflection is greater than the second indentation force deflection; and wherein the relationship of first indentation force deflection, second indentation force deflection and third indentation force deflection is defined by the relationships:

$$A=(C/5.3)\text{plus or minus } 5$$

$$B=2(C/5.3)\text{plus or minus } 5$$

wherein A represents the second indentation force deflection, B represents the third indentation force deflection and C represents the first indentation force deflection.

2. The mattress of claim 1, wherein C equals 80 plus or minus 5.

3. The mattress of claim 1, wherein the core foam layer comprises polyurethane and wherein the first density is between about 2.5 pounds per cubic foot and about 3.0 pounds per cubic foot and the first indentation force deflection is from about 75 to about 90 and the first thickness is from about one half inch to about five inches.

4. The mattress of claim 1, wherein the intermediate foam layer comprises polyurethane wherein the third density is between about one and one half pounds per cubic foot and about two and one half pounds per cubic foot and the third indentation force deflection is from about twenty five to about thirty five and the third thickness is from about one half inch to about three inches.

5. The mattress of claim 1, wherein the top outer foam layer comprises polyurethane, latex or a combination thereof and wherein the second density is from about two and three quarters to four and one half pounds per cubic foot, the second indentation force deflection is from about ten to twenty and the second thickness is from about one half to about three inches.

6. The mattress of claim 1, wherein the top outer foam layer has a softness compression modulus of about 1.75 to about 2.35.

7. The mattress of claim 1, wherein the first intermediate foam layer has a support compression modulus of about 1.7 to about 2.6.

8. The mattress of claim 1, wherein the core layer has a support compression modulus of about 1.9 to about 2.3.

9. The mattress of claim 1, further comprising a bottom outer foam layer and second intermediate foam layer intermediate and coextensive with the core layer and the bottom outer layer.

10. The mattress of claim 1, wherein the bottom outer foam layer has the second indentation force deflection at twenty five percent compression and the second density and the second intermediate foam layer has the third indentation force deflection at twenty five percent compression and the third density.

11. A method of making a mattress comprising:

bonding a core foam layer having a first indentation force deflection at twenty five percent compression, a first density and a first thickness to a first intermediate foam layer that is substantially coextensive with the core layer;

bonding a top outer foam layer to the first intermediate foam layer;

selecting the top outer foam layer to have a second indentation force deflection at twenty five percent compression, second density and a second thickness;

selecting the intermediate layer to have a third indentation force deflection at twenty five percent compression, a third density and a third intermediate thickness;

wherein the first indentation force deflection is greater than the third indentation force deflection and the third indentation force deflection is greater than the second indentation force deflection; and selecting the relationship of first indentation force deflection, second indentation force deflection and third indentation force deflection to be defined by the relationships $A=(C/5.3)$plus or minus 5

$B=2(C/5.3)$plus or minus 5 wherein A represents the second indentation force deflection, B represents the third indentation force deflection and C represents the first indentation force deflection.

12. The method of claim 11, further comprising selecting the first indentation force deflection such that C equals 80 plus or minus 5.

13. The method of claim 11, further comprising selecting the core foam layer to comprise polyurethane and such that the first density is between about 2.5 pounds per cubic foot and about 3.0 pounds per cubic foot, the first indentation force deflection is from about 75 to about 90 and the first thickness is from about one half inch to about five inches.

14. The method of claim 11, further comprising selecting the intermediate foam layer to comprise polyurethane and such that the third density is between about one and one half pounds per cubic foot and about two and one half pounds per cubic foot, the third indentation force deflection is from about twenty five to about thirty five and the third thickness is from about one half inch to about three inches.

15. The method of claim 11, further comprising selecting the top outer foam layer to comprise polyurethane, latex or a combination thereof and such that the second density is from about two and three quarters to four and one half pounds per cubic foot, the second indentation force deflection is from about ten to twenty and the second thickness is from about one half to about three inches.

16. The method of claim 11, further comprising selecting the top outer foam layer to have a softness compression modulus of about 1.75 to about 2.35.

17. The method of claim 11, further comprising selecting the first intermediate foam layer to have a support compression modulus of about 1.7 to about 2.6.

18. The method of claim 11, further comprising selecting the core layer to have a support compression modulus of about 1.9 to about 2.3.

19. The method of claim 11, further comprising bonding a second intermediate foam layer to the core foam layer and bonding a bottom outer foam layer to the intermediate foam layer such that the second intermediate foam layer is intermediate between and coextensive with the core layer and the bottom outer layer.

20. The method of claim 11, further comprising selecting the bottom outer foam layer to have the second indentation force deflection at twenty five percent compression and the second density and selecting the second intermediate foam layer to have the third indentation force deflection at twenty five percent compression and the third density.

* * * * *